United States Patent [19]

Wasserman et al.

[11] 4,009,231

[45] Feb. 22, 1977

[54] POWDER BARRIER BONDING TECHNIQUE

[75] Inventors: Bernard Wasserman; William H. Thielbahr, both of Ridgecrest, Calif.

[73] Assignee: The United States of America as represented by the Secretary of the Navy, Washington, D.C.

[22] Filed: Mar. 20, 1975

[21] Appl. No.: 560,077

[52] U.S. Cl. ..... 264/3 R; 102/103

[51] Int. Cl.[2] ..... C06B 21/00

[58] Field of Search ..... 264/3 R; 102/103

[56] References Cited

UNITED STATES PATENTS

| | | | |
|---|---|---|---|
| 3,301,924 | 1/1967 | Bryant et al. | 264/3 R |
| 3,578,520 | 5/1971 | Dolan et al. | 102/103 |
| 3,813,308 | 5/1974 | Skidmore | 102/103 |
| 3,855,176 | 12/1974 | Skidmore | 102/103 |

*Primary Examiner*—Leland A. Sebastian

*Attorney, Agent, or Firm*—R. S. Sciascia; Roy Miller; L. E. K. Pohl

[57] ABSTRACT

A barrier layer made up of a suitable powder interspersed within either a matrix of cured propellant binder or a matrix of silicone rubber is interposed between a silicone rubber insulator and a solid propellant grain in a rocket motor to prevent curatives from migrating from the propellant into the silicone rubber layer when the propellant is cast.

6 Claims, No Drawings

POWDER BARRIER BONDING TECHNIQUE

BACKGROUND OF THE INVENTION

1. Field of the Invention

This invention relates to a means for preventing certain materials from migrating from the propellant grain into the silicone rubber insulation layer of a rocket motor.

2. Description of the Prior Art

It has recently been discovered that silicone rubber is an excellent insulator for rockets and ramjets. A layer of silicone rubber interposed between a solid rocket propellant grain and a metallic rocket motor case does an excellent job of insulating the case from heat damage when the propellant is burned. However, when solid propellant is cast and cured into a metallic shell lined internally with silicone insulation, propellant curatives will migrate from the propellant into the silicone rubber layer. When this occurs, a poorly cured propellant near the silicone-to-propellant interface results.

SUMMARY OF THE INVENTION

According to this invention, the above-mentioned problem is solved by interposing a barrier layer between the silicone rubber insulator layer and the solid propellant grain of a rocket motor. The barrier layer may be either a composite layer made up of a suitable powder interspersed within a matrix of cured propellant binder or a composite made up of a suitable powder interspersed within a silicone rubber matrix.

DESCRIPTION OF THE PREFERRED EMBODIMENTS

In practicing this invention, either of two methods may be utilized with equal facility.

In one method, the following steps are carried out. First, a layer of silicone rubber insulation is cast onto the internal surface of the rocket motor case and cured. Upon curing, it bonds to the motor casing. Next, a layer of binder material (such as hydroxy or carboxy terminated polybutadiene or the like) containing an appropriate powder is applied to the silicone rubber insulator layer and cured. This forms what is referred to herein as the barrier layer. Upon curing, the barrier layer bonds to the silicone rubber insulator layer. Finally, in this method, the propellant grain is cast and cured onto the barrier layer. Upon curing, the propellant grain bonds to the barrier layer.

In the other method, a layer of silicone rubber insulation is cast onto the internal surface of the rocket motor case and cured. Next, a layer of uncured silicone rubber containing an appropriate powder is applied to the insulation surface. Then the silicone rubber with its powder filler is allowed to cure. Finally, the propellant grain is cast and cured onto the powder-filled silicone rubber layer. In this method, the barrier layer that is actually formed is a composite made up of an appropriate powder within a matrix of silicone rubber. This composite is a thin layer of material on the inner surface of a silicone rubber layer. As in the first process, the silicone rubber layer bonds to the metallic motor casing, the barrier bonds to the silicone rubber layer and the propellant bonds to the barrier layer.

In practicing this invention, copper and silica have been found to be particularly "appropriate" powders. When a solid propellant rocket motor which contain copper powder as part of the barrier layer is fired, copper either produces very little exotherm or is simply expelled from the motor. The same is true for silica. Other powders such as aluminum powder, other metal powders, and other mineral powders can be used.

Hydroxy and carboxy terminated polybotadiene have been mentioned above as being suitable for use as the matric material of the barrier layer. Other commonly used binder materials may possibly be used. What one strives to do is produce a barrier layer which bonds strongly to both the silicone rubber layer and the propellant layer and which has enough filler (copper, silica, etc.) in it to prevent or substantially reduce migration of curing agents from the propellant into the silicone rubber layer while the propellant is curing.

In actual tests comparing bond specimens containing a silica-carboxy terminated polybutadiene barrier layer made up according to the first method outlined above with specimens containing no barrier layer, it was found that migration was either prevented or that it was significantly reduced in the motors that contained the barrier layers. That is, when a barrier layer was utilized, the propellant (containing either hydroxy terminated polybutadiene binder or carboxy terminated polybutadiene binder) cured completely and bonded very strongly to the barrier layer which, in turn, bonded very strongly to the silicone rubber insulator layer. On the other hand, in specimens where no barrier layer was incorporated, similar propellants tended to cure poorly on the surface and bonded poorly to the silicone rubber layer. A range of from 65 to 75 weight percent silica powder to from 35 to 25 weight percent carboxy terminated polybutadiene appeared to be optimum. The silica powder used had particle sizes in the range of from 1 to 10 microns. However, finer particle sizes could be used. Weight percentages and particle sizes in the above-specified ranges may be utilized when copper or aluminum powder are used in lieu of silica and when other binders are used in lieu of carboxy terminated polybutadiene.

It will be apparent that, no matter what binder is used, each particular binder has curing agents which are particularly suited to it and that these curing agents may be used in the usual manner. Methods of curing binders, including silicone rubber if the second method outlined above is used, are well known in the art and need not be gone into in detail here.

What is claimed is:

1. In a method for loading a rocket motor which comprises casting and curing a solid propellant within a combustion chamber which is lined with a layer of cured silicone rubber insulator material, the improvement residing in casting and curing a barrier layer on said layer of insulator material before casting and curing the propellant grain to prevent materials in the propellant grain from migrating into the insulator layer as the propellant grain cures.

2. In a method according to claim 1 the additional improvement residing in utilizing, as said barrier layer, a composite made up of a powder selected from the group consisting of copper, silica and aluminum interspersed in a matrix of binder selected from the group consisting of carboxy and hydroxy terminated polybutadiene.

3. A method according to claim 2 wherein the powder is silica powder and the matrix is carboxy terminated polybutadiene.

4. A method according to claim 3 wherein from 65 to 75 weight percent of the barrier layer is silica and wherein from 35 to 25 weight percent of the barrier layer is carboxy terminated polybutadiene.

5. A method for providing a barrier layer to substantially prevent migration of a curing agent from a solid propellant grain into an insulation layer comprising the steps of:

1. applying an uncured blend of silicone rubber and a powder onto the cured insulation; and

2. allowing said barrier layer to cure.

6. A method according to claim 5 wherein said insulation layer is made up of silicone rubber and wherein said powder is selected from the group consisting of copper powder, silica powder and aluminum powder.

* * * * *